US008327762B2

(12) United States Patent
Masuch et al.

(10) Patent No.: US 8,327,762 B2
(45) Date of Patent: Dec. 11, 2012

(54) PRINTING PRESSES HAVING ONE OR MORE PRINTING UNITS EMBODIED AS PRINTING TOWERS FOR DOUBLE-SIDED MULTICOLOR PRINTING, AND DEVICES FOR CONTROLLING THE TEMPERATURE OF COMPONENTS OF ONE OR MORE OF THE PRINTING UNITS

(75) Inventors: Bernd Kurt Masuch, Kürnach (DE); Daniela Müller, Veitshöchheim (DE)

(73) Assignee: Koenig & Bauer Aktiengsellschaft, Wurzburg (DE)

( * ) Notice: Subject to any disclaimer, the term of this patent is extended or adjusted under 35 U.S.C. 154(b) by 0 days.

(21) Appl. No.: 13/138,640

(22) PCT Filed: Dec. 17, 2009

(86) PCT No.: PCT/EP2009/067408

§ 371 (c)(1),
(2), (4) Date: Oct. 17, 2011

(87) PCT Pub. No.: WO2010/105711

PCT Pub. Date: Sep. 23, 2010

(65) Prior Publication Data

US 2012/0037017 A1 Feb. 16, 2012

(30) Foreign Application Priority Data

Mar. 17, 2009 (DE) ..... 10 2009 001 596
Mar. 17, 2009 (DE) ..... 10 2009 001 597
Mar. 17, 2009 (DE) ..... 10 2009 001 598

(51) Int. Cl.
*B41F 5/16* (2006.01)

(52) U.S. Cl. ..... 101/183; 101/487; 101/216; 101/174

(58) Field of Classification Search ..... 101/183, 101/487, 216, 153, 178, 174, 141
See application file for complete search history.

(56) References Cited

U.S. PATENT DOCUMENTS 4,958,525 A 9/1990 Hauer et al.
(Continued)

FOREIGN PATENT DOCUMENTS

DE 38 22 486 A1 1/1990
(Continued)

*Primary Examiner* — Matthew G Marini
(74) *Attorney, Agent, or Firm* — Mattingly & Malur, P.C.

(57) ABSTRACT

A printing machine, which is configured as a printing tower having a plurality of printing units, is usable for double-sided, multicolor printing. A device that is usable for controlling the temperature of the components of one or more of the printing couples is provided. Each printing unit includes a plurality of printing towers that are disposed vertically one over the other. Each of these printing devices has at least one component that is to be temperature controlled and which has a thermal interaction with a fluid of a secondary circuit by way of an inlet. The secondary circuit can have fluid of a primary circuit entered by a feeding station for controlling the temperature. Components that are to be temperature controlled, and that are part of at least two different printing devices, have thermal interactions with two secondary circuits that are different from each other. A selectively actuable electrical heating appliance is provided in the secondary circuit in addition to the feeding station and at least one of valves and pumps and heating appliances that are associated with the two secondary circuits and different from each other are disposed on a machine front side at different heights or can be fed with fluid from the primary units by feeding stations that are disposed at different heights.

33 Claims, 4 Drawing Sheets

U.S. PATENT DOCUMENTS

| | | | |
|---|---|---|---|
| 5,603,261 | A | 2/1997 | Buenz |
| 5,694,848 | A | 12/1997 | Palmatier |
| 6,289,984 | B1 | 9/2001 | Lagger |
| 7,114,447 | B2 | 10/2006 | Xifra I Boada et al. |
| 7,740,185 | B2 | 6/2010 | Muller |
| 2008/0017061 | A1 | 1/2008 | Muller et al. |
| 2008/0041258 | A1 | 2/2008 | Schneider et al. |

FOREIGN PATENT DOCUMENTS

| | | | |
|---|---|---|---|
| DE | 200 12 101 | | 2/2000 |
| DE | 10 2005 005 303 | A1 | 7/2006 |
| DE | 10 2007 003 619 | A1 | 8/2007 |
| DE | 602 22 706 | | 6/2008 |
| EP | 0 383 295 | A2 | 8/1990 |
| EP | 0 886 577 | B1 | 12/1999 |
| EP | 1 008 448 | A1 | 6/2000 |
| WO | 2004/054805 | A1 | 7/2004 |
| WO | 2006/072558 | A1 | 7/2006 |

PRINTING PRESSES HAVING ONE OR MORE PRINTING UNITS EMBODIED AS PRINTING TOWERS FOR DOUBLE-SIDED MULTICOLOR PRINTING, AND DEVICES FOR CONTROLLING THE TEMPERATURE OF COMPONENTS OF ONE OR MORE OF THE PRINTING UNITS

CROSS-REFERENCE TO RELATED APPLICATIONS

This application is the U.S. national phase, under 35 U.S.C. 371, of PCT/EP2009/067408, filed Dec. 17, 2009; published as WO2010/105711 A2 and A3 on Sep. 23, 2010, and claiming priority to DE 10 2009 001 598.1, filed Mar. 17, 2009, to DE 2009 001 597.3, filed Mar. 17, 2009, and to DE 10 2009 001 596.5, also filed Mar. 17, 2009, the disclosures of which are expressly incorporated herein by reference.

FIELD OF THE INVENTION

The invention relates to printing presses having one or more printing units embodied as printing towers for double-sided multicolor printing and to devices for controlling the temperature of components of one or more of the printing units. A printing press is embodied as having one or more printing units which are configured as printing towers for accomplishing double-sided, multicolor printing. A device is usable to control the temperature of components of at least one of the printing couples. The printing towers have a plurality of printing couples which are arranged vertically one above the other. Each such printing unit has at least one component that is to be temperature controlled. The at least one component, which is to be temperature controlled, is in thermal interaction, for its temperature control, with a secondary circuit. The secondary circuit has at least one pump and one infeed point. Fluid from a primary circuit can be metered, using a valve, at an infeed point of the secondary circuit. This control of the flow of fluid from the primary circuit of fluid into the secondary circuit is utilized to control the temperature of the fluid in the secondary circuit.

BACKGROUND OF THE INVENTION

From WO 2004/054805 A1, a method and a device for controlling the temperature of a component of a printing unit are known, wherein a fluid circulating in a circuit is in thermal contact with the component to be temperature controlled. Temperature-controlled fluid is fed into the fluid of the circuit via a primary circuit as needed for the purpose of adjusting a desired fluid temperature. Alternatively, it is also possible for a heating or cooling unit to be provided in the temperature control circuit.

WO 2006/072558 A1 also discloses a temperature control system for controlling the temperature of components. In this case, temperature control medium at three different temperature levels is provided via three supply circuits to a decentralized supply unit close to the printing tower. Using these supply circuits, individual temperature control circuits for the rollers/cylinders are supplied as necessary with fluid, metered in from one of the supply circuits.

EP 0 383 295 A2 discloses a temperature control device for a printing couple cylinder, wherein a desired mixed temperature for the temperature control circuit can be produced using fluid suitably supplied and discharged at a four-way valve as the junction point between a primary circuit and the temperature control circuit for controlling the temperature of the component. In the primary circuit, a heat exchanger is provided for cooling the fluid, and a heating element is provided for cases in which preheating is required.

A device for controlling the temperature of a component is also disclosed in EP 0 886 577 B1. In one embodiment, cooling medium circulates continuously in a temperature control circuit through the cylinder or cylinders to be temperature controlled and through a cooling unit, in which the temperature of the cooling medium is controlled as needed via a control unit. A cylinder through which the medium flows has an intake and an outlet for the cooling medium on the transmission side. The cooling unit can be embodied to lower or raise the temperature of the cooling medium. One embodiment provides for the temperature control of a side panel of the printing couple on the transmission side, opposite the operating side. This is accomplished using the transmission fluid circulating in a circuit, with the temperature of said fluid being controllable via a heat exchanger in a primary circuit which has a temperature control unit.

From DE 38 22 486 A1, a driven roller embodied for measuring web tension is disclosed, which has a drive wheel at one end face and, in a special embodiment of the roller as a cooling roller, has an intake and a discharge for cooling medium on the other side.

DE 10 2007 003 619 A1 relates to a sheet-fed printing press having a central temperature control device. The sheet-fed printing press has a plurality of printing couples, arranged vertically, one in front of the other, the inking and dampening units of which are temperature controlled. For this purpose, a primary circuit is provided, which is temperature controlled by the temperature control device, and the flow from which is supplied to internal temperature control circuits, each having a pump, via metering valves. The temperature control device can be used to cool or heat the primary circuit fluid.

DE 10 2005 005 303 A1 discloses a temperature control system in which fluid which is temperature-controlled by a central cooling unit is conducted in an external cooling circuit. For the printing couples of one or more printing towers of each press section, one decentralized supply device is provided, wherein in this supply device, the external cooling circuit feeds into a plurality of internal temperature control circuits as needed for the purpose of controlling the temperature of rollers and cylinders of the printing tower. For each of the internal circuits, the supply unit comprises a control valve for metering the fluid into the internal circuit, and a pump for pumping fluid in the internal circuit. An external hot water circuit may also be provided, which can also dispense fluid in the region of the supply unit for controlling the temperature of a plurality of internal temperature control circuits.

U.S. Pat. No. 5,603,261 A describes a printing press having printing couples arranged vertically, one in front of the other, with rollers to be temperature controlled. Temperature control is implemented via hose lines from a central temperature control device.

DE 200 12 101 U1 discloses a concept for supplying a printing press and teaches combining all the supply systems for peripheral functions in a printing press as modules in a compact supply assembly. In a cooling module, cooling fluid is provided. In a "fluid module", for example, dampening agent is cooled by the cooling fluid of the first circuit, for example, before being resupplied to the dampening units of the printing press. Also in the fluid module, a device for controlling the temperature of ink oscillator rollers by means of a temperature control circuit can be provided, wherein the cooling energy is supplied to the temperature control circuit in the fluid module via an exchange of heat with the fluid of the cooling module or by adding cooling fluid from the circuit of the cooling module. In one embodiment of dry offset printing requiring different fluid temperatures for different rollers, for each temperature level, a temperature circuit having a pump and a regulating valve 29 is provided in the central module. An electric heating element can also be assigned to each temperature control circuit in the central module.

DE 602 22 706 T2 discloses a flexographic printing press with means for air circulation.

SUMMARY OF THE INVENTION

The problem addressed by the invention is that of devising printing presses comprising one or more printing units embodied as printing towers for double-sided multicolor printing and devices for controlling the temperature of components of one or more of the printing units.

The problem is solved according to the invention by the provision, in addition to the infeed point, of a selectively actuable electric heating appliance in the secondary circuit. At least one of the valves and the pumps and the heating appliances, which are assigned to the secondary circuit or circuits, is disposed on an end face of the machine at different heights from each other. The at least one of the valves, pumps, and heating appliances can also be supplied with fluid from the primary circuit at infeed points of different heights. Two of the secondary circuits can be connected, via valves, to a single, essentially vertically extending infeed line of the primary circuit. The secondary circuits, which are located at different heights, are positioned on an end face of the printing machine which is opposite the drive side. At least one primary circuit branch is assigned to each printing unit. Each such primary circuit branch is connected to a common, higher-level circuit. Each of the primary circuit branches has at least one pump assigned to it. A depression may be provided at one end face of the printing unit, in a base plane that supports the printing unit. At least one pump can be located in the depression and is usable to pump the fluid of the primary circuit. This pump is recessed in relation to the surrounding area.

The advantages to be achieved by the invention consist especially in that more rapid reaction times for controlling the temperature of the components to be temperature controlled, particularly cylinders and/or rollers, can be attained.

For one, substantially shorter line routes, and therefore less temperature control fluid circulation and shorter transport times are required.

One embodiment comprising a heating appliance disposed in the secondary circuit allows a supply of heating fluid, a separate heating primary circuit, or a heating of a primary circuit to be dispensed with.

By arranging all the assemblies and/or units of the primary circuit near the component, in addition to the shorter lines, lower pumping capacities are required.

It is particularly advantageous to dispose the units of the primary circuit for roller or cylinder temperature control on a machine side of the printing unit that is opposite the drive side (frequently called the operating side), because intake and return flow can be implemented without taking the drive of the cylinders/rollers into consideration. It is of particular advantage in this case to arrange the units, or at least essential units, of the primary circuit or of a loop of the primary circuit assigned to the printing unit, in a plane that is below the main operating plane and/or in a plane that is below the base of the printing unit, for example, in a depression or trench that can be covered, for example.

BRIEF DESCRIPTION OF THE DRAWINGS

One embodiment example of the invention is illustrated in the set of drawings and will be specified in greater detail in what follows.

The drawings show.

DESCRIPTION OF THE PREFERRED EMBODIMENT

Figure 1:
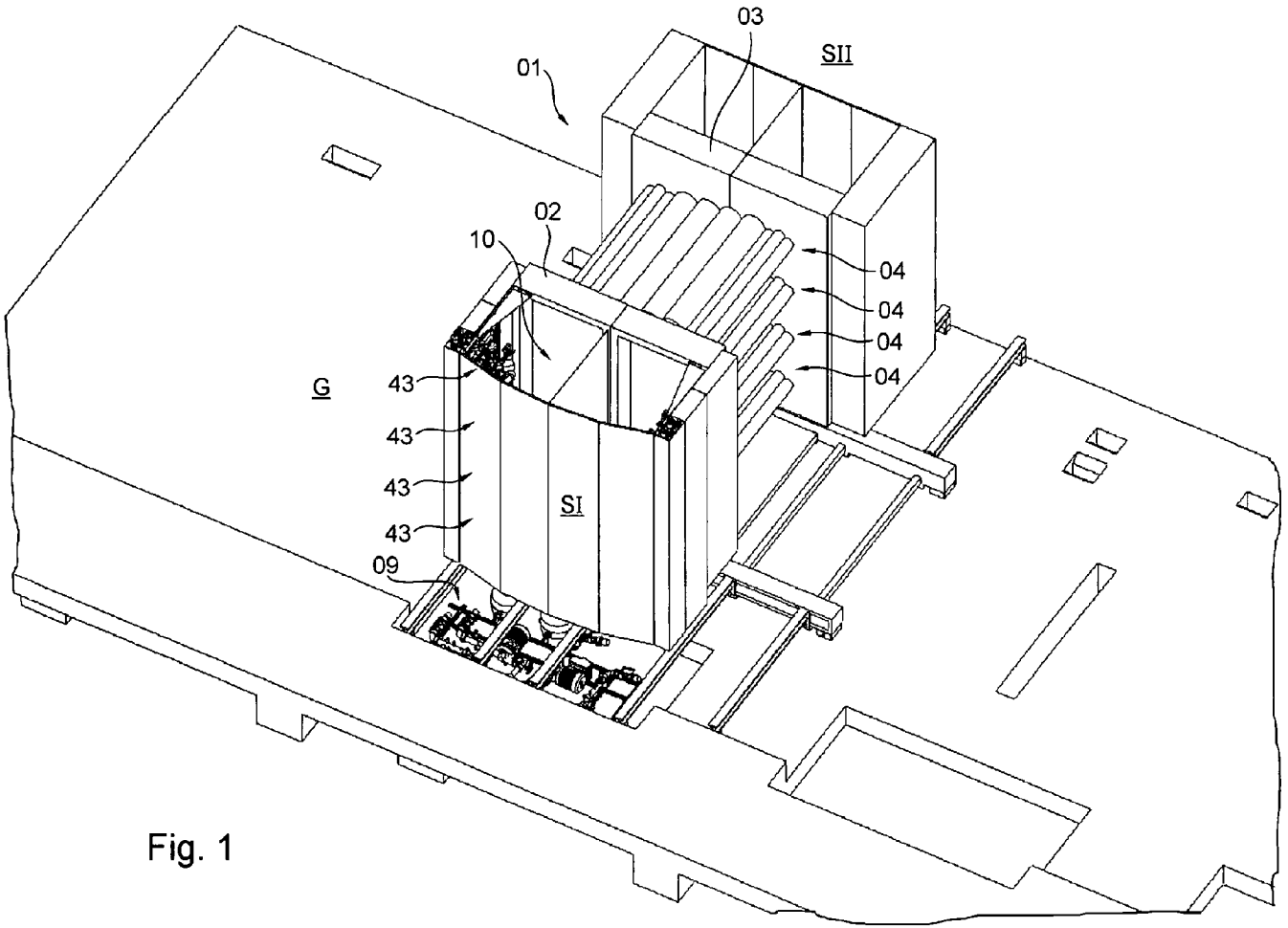
FIG. 1 a perspective illustration of a printing unit.

A printing press, for example, a web-fed rotary printing press, has one or more printing units 01 for double-sided multicolor printing of print substrates, for example, material webs, preferably paper webs, particularly webs of newsprint paper. FIG. 1 shows a perspective illustration of one embodiment of a printing unit 01, in which a web of material, or web, not shown here, can be printed on both sides, a single time or more particularly, multiple times successively, for example, in this case four times, or multiple webs can be printed simultaneously a single time or multiple times. The printing unit 01, embodied as a printing tower 01—with an essentially vertical web path—has a plurality of printing couples 04, particularly a plurality of blanket-to-blanket printing couples (in the present case four) arranged vertically one above the other, each comprising two interacting printing couples 04 for double-sided printing in blanket-to-blanket operation. However, satellite printing units could also be provided in principle, stacked to form a printing tower 01. Due to the vertically stacked printing couples and the web travel extending from the bottom upward, this is also to be understood as a printing tower having an essentially vertical web path—in contrast to commercial web printing, for example. The printing unit 01 has two side frames 02; 03, in which the cylinders and rollers of the printing unit 01 are mounted at the end faces thereof. In one advantageous embodiment, the printing unit 01 is embodied as operationally separable, i.e., for repair and maintenance purposes (as compared with dismantling or disassembly), in the region of its (blanket-to-blanket) print position(s) 05. For this purpose, the printing couple cylinders 06; 07 of the plurality of blanket-to-blanket printing couples (four) arranged one above the other are mounted rotatably in or on one right and one left frame section or side frame section, such that the two printing couple cylinders 06; 07 are assigned to the same printing couple 04 of the same frame section or side frame section. Preferably, the printing couple cylinders 06; 07 of a plurality of printing couples 04, particularly all, that imprint the web on the same side are mounted on the same frame section or side frame section of the corresponding side frame 02; 03. The two side frame sections of a side frame 02; 03, along with the printing couples 04 they support, can be moved to a position in which they are spaced from one another.

The side frames 02; 03 of the printing unit 01 rest on a base plane G of the printing press, which also essentially represents a main operating plane G, at least for the lower printing couples 04 of the printing unit 01. In one embodiment, units of a temperature control device, described in greater detail below, are disposed recessed, for example, in a correspondingly embodied cavity 09, for example, a trench 09, in this base plane G, which also comprises the floor surface of the printing unit 01, for example. In this case, the units of the temperature control device are, or the trench 09 is, preferably disposed on the side SI of the printing unit 01, which is different from a side SII, for example, drive side SII (see below).

Figure 2:
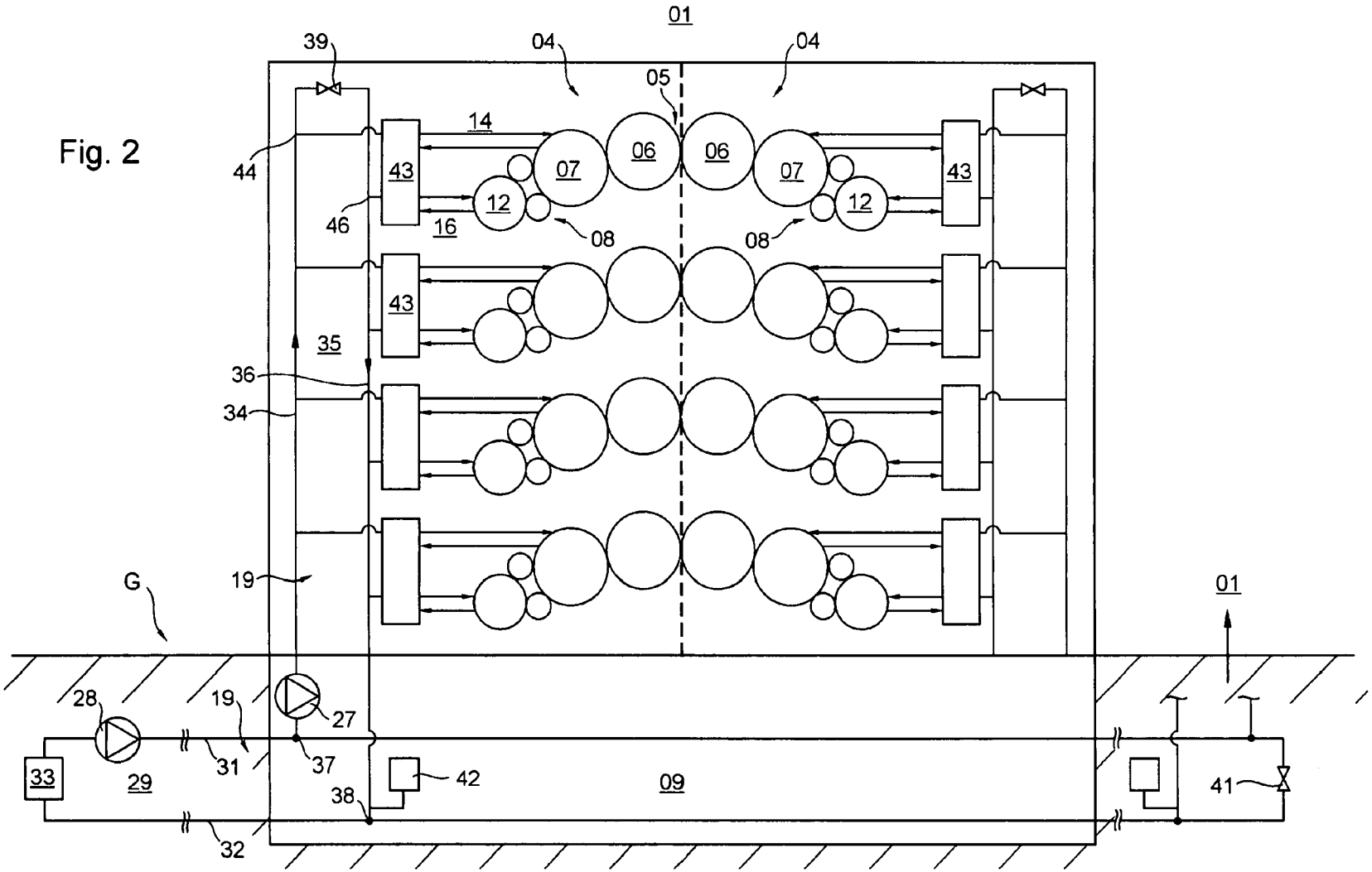
FIG. 2 a schematic side view of a printing unit on the machine side that is opposite the drive side.

Each of the blanket-to-blanket printing couples illustrated schematically in FIG. 2 is formed by two printing couples 04, each comprising cylinders 06; 07, for example, printing couple cylinders 06; 07, one embodied as transfer cylinder 06 and one as forme cylinder 07, and an inking unit 08. In each case, between the two transfer cylinders 06, a (blanket-to-blanket) print position 05 is formed in the thrown-on position. The stated components are labeled only in the uppermost blanket-to-blanket printing couple of FIG. 2, however, the (blanket-to-blanket) printing couples 04, arranged one above the other, are embodied as essentially identical—particularly in terms of the embodiment of the features that are relevant to the invention. The four cylinders 06; 07 of the blanket-to-blanket printing couples can preferably be embodied—as shown—with their rotational axes lying in the same shared plane in the print-on position.

Figure 3:
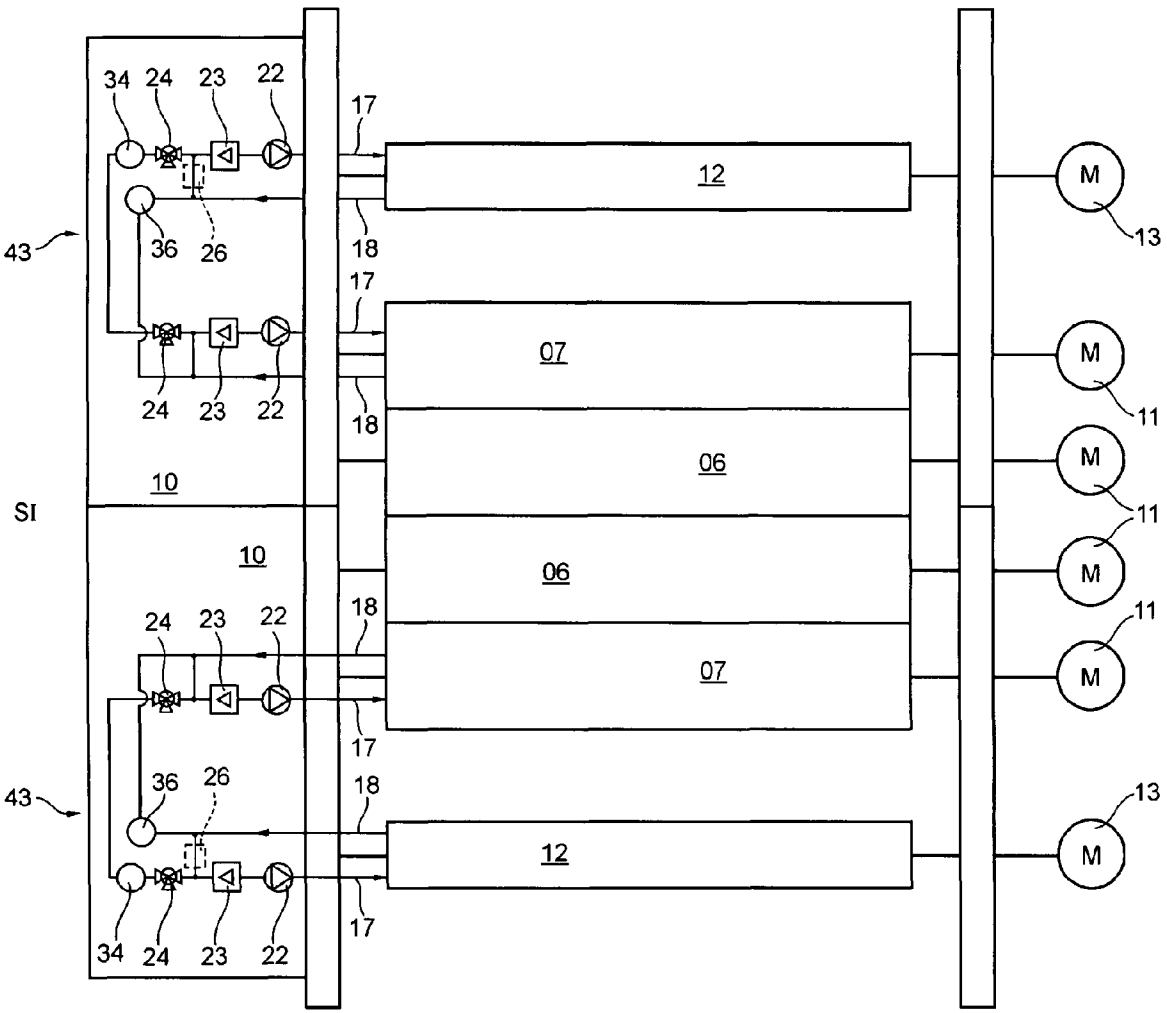
FIG. 3 a schematic plan view of a printing couple of the printing unit.

In this case, the printing couples 04 are preferably embodied as dry offset printing couples for "dry offset" or "waterless offset printing", i.e., the printing formes and inking unit 08 are embodied such that no dampening agent, and therefore, no dampening unit is provided. The cylinders 06; 07 of each blanket-to-blanket printing couple are rotationally driven by at least one drive motor 11, which is mechanically independent of other blanket-to-blanket printing couples (FIG. 3). Advantageously, the two cylinders 06; 07 of each printing couple 04 are rotationally driven by at least one drive motor 11, but preferably each is driven by its own drive motor 11.

The inking unit 08 has at least one roller 12 to be temperature controlled, for example, inking unit roller 12. This unit is advantageously embodied as a short train inking unit 08 and has a roller 12 to be temperature controlled, with tri-helix cells or cells, for example, an anilox roller 12, which draws the ink from an ink application device, particularly an ink chamber blade (or from an inking fountain via a roller train not shown here), and delivers it to the printing forme of the forme cylinder 07 via at least one, preferably at least two roller(s), for example, forme rollers, the surface of which is particularly softer than that of the anilox roller 12. The anilox roller 12 can be rotationally driven by the printing couple cylinders 06; 07 via a drive connection, but is preferably rotationally driven by its own drive motor 13, which is independent of the cylinders 06; 07. The remaining rollers are preferably driven via friction.

The drive motors 11; 13 at least of the cylinders 06; 07 and preferably of the rollers 12 (and of any drive connections that are present) are disposed on one side II, for example, drive side SII, of the printing unit 01. On this side SII, a line of a cooling circuit that controls the temperature of the drive motors 11; 13 can also be provided. In the case of a printing unit 01 that is embodied as separable, at least two cooling circuits for controlling the temperature of the drive motors 11; 13, specifically at least one per side frame section, are then provided.

Figure 4:
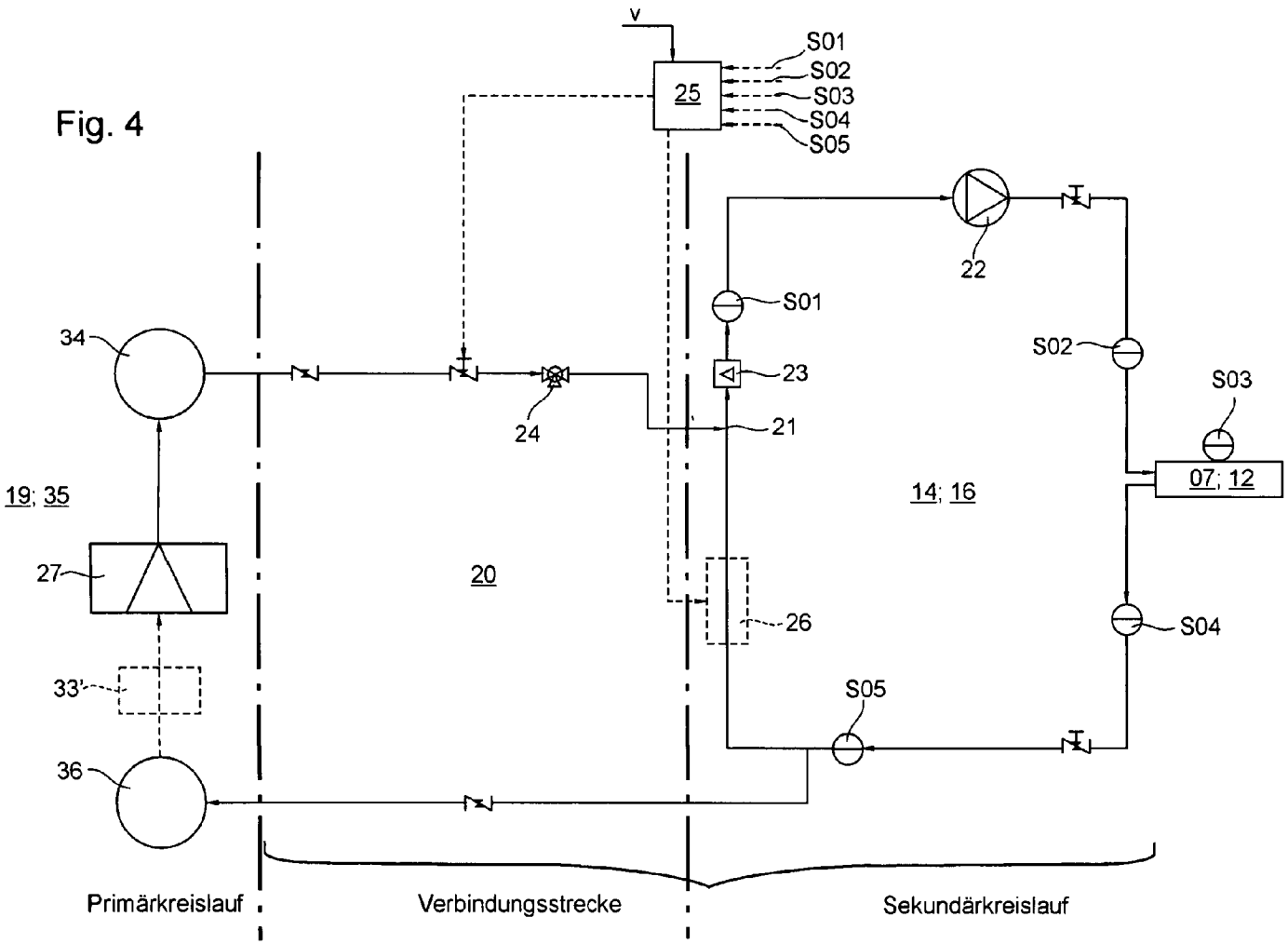
FIG. 4 a diagram illustrating temperature control by means of a secondary circuit.

At least one rotating component 07; 12, particularly a component 06; 07; 12 embodied as a roller 12 and/or as a cylinder 06; 07 of the printing unit 01, preferably of each printing couple 04 of the printing unit 01, is embodied as temperature controllable. To accomplish this, the relevant roller 12 or the relevant cylinder 06; 07 is in thermal interaction with a temperature control circuit 14; 16 (FIG. 4). Here, this circuit is embodied as a fluid-conducting secondary circuit 14; 16, wherein fluid is supplied to the component 06; 07; 12 (of the roller "type" and/or of the cylinder "type", particularly a forme cylinder) via an intake 17 and is discharged therefrom via an outlet 18. Preferably, for each of the printing couples 04 of the printing unit 01, one temperature control circuit 14 is provided for controlling the temperature of a component 07 embodied as a forme cylinder 07, and one temperature control circuit 16 is provided for controlling the temperature of a component 12 embodied as an anilox roller 12.

The intake and outlet of temperature-control fluid at the component 07; 12 to be temperature controlled is preferably carried out on the side I of the printing unit 01 that is opposite the drive side II, i.e., on the side of the "operating side" side frame 02. Intake 17 and outlet 18 are indicated here merely by arrows, and can be embodied in a known manner as rotating unions, particularly as conduits disposed coaxially in relation to one another and to the rotational axis.

The temperature control device is formed, for one, by the temperature control circuit 14; 16 (as secondary circuit 14; 16) mentioned above, which is in contact with the component 07; 12 to be temperature controlled. Cooler fluid can be added to the fluid of the secondary circuit 14; 16 as needed for controlling the temperature thereof using fluid from a primary circuit 19, via a corresponding connecting route 20 (FIG. 4). For this purpose, the temperature circuit 14; 16 has at least one infeed point 21 for fluid from the primary circuit 19 and one pump 22, and at least one temperature sensor S01; S02; S03; S04; S05, particularly at least one temperature sensor S01; S02; S03 situated upstream of or assigned to the component 07; 12. Preferably, the temperature circuit 14; 16 has at least one temperature sensor S01 near the infeed point, and one temperature sensor S02; S03 near the component. The temperature sensor S01 near the infeed point is preferably located between infeed point 21 and pump 22. The latter is advantageously located upstream of the component 07; 12 to be temperature controlled. Between infeed point 21 and first temperature sensor S01, a swirling chamber 23 can advantageously be provided, which ensures thorough mixing produced by swirling due to its shape, the cross-section of which is different from that of the infeed line. In addition to, or in some cases in place of, the stated temperature sensors S01; S02; S03, a temperature sensor S04 near the component and/or a temperature sensor S05 near the infeed point can be provided downstream of the component 07; 12, in the return flow. The measured value from the at least one temperature sensor or from a plurality of the represented temperature sensors, or from all of the illustrated temperature sensors S01; S02; S03; S04; S05 is supplied to a control and/or regulating apparatus 25, which is indicated in FIG. 4 without reference to spatial positioning, and which acts on a valve 24, for example, metering valve 24, particularly a digital mixing valve, which is located between primary circuit 19 and secondary circuit 14; 16. In one embodiment, the valve 24 can also be positioned directly in the secondary circuit 14; 16, for example, as a three-way valve, in which case the intake into the valve 24 from the primary circuit side also represents the infeed point 21. In that case, although an infeed point 21 and a valve 24 are provided, these coincide quasi spatially.

In one advantageous embodiment of the secondary circuit 14; 16, particularly a secondary circuit 16 assigned to one of the anilox rollers 12, a heating appliance 26, for example, an electric heating appliance, for example, a "cartridge heater", which can alternatively be activated and/or controlled via the control and/or regulating apparatus 25, is provided in the circuit. This heating appliance 26 can be used to raise the temperature of the circulating fluid, and therefore of the component 07; 12 to be temperature controlled. This is particularly advantageous during the startup phase of the press, particularly for controlling the temperature of the anilox roller 12, since the volume of ink to be taken up is controlled by the temperature of the anilox roller 12. For controlling the temperature of the forme cylinder 07, the heating appliance 26 can be dispensed with, since the behavior thereof reacts less sensitively to temperature.

With the option of heating during start-up, the anilox roller 12 can therefore be brought to the necessary operating temperature even without the frictional heat resulting from operation. If the temperature later increases during operation of the printing press, the heating appliance 26 can be deactivated, and the temperature can be controlled by adding cooling fluid to it as needed from the cooler primary circuit 19. Preferably, the heating appliance 26 is also controlled via the aforementioned control and/or regulating apparatus 25. The temperature of the secondary circuit 14; 16 is preferably controlled as follows: Data relating to the printing process, particularly an indication of the target and/or actual speed v and/or data relating to the type of ink being used, are supplied to the control and/or regulating apparatus 25—for example, via logic implemented by a higher-level machine controller or by a control panel. On the basis of these data, a suitable target temperature (optionally only a maximum temperature) for the component 07; 12 to be temperature controlled is determined using appropriate memory and/or computing means. The means for determining the target temperature need not be structurally housed in the same physical control and/or regulating apparatus 25, and may instead be provided in the control panel itself or in a machine control system. In that case, the target temperatures are transferred via data transmission means to the aforementioned control and/or regulating apparatus 25 as target values. A single or multiple loop control of the control and/or regulation apparatus 25 compares one or more of the actual temperatures (at S01, etc.) with the relevant target value, and executes its program accordingly on the valve 24, and on the heating appliance 26, if one is present, as needed in order to produce the target temperature in the component 07; 12, or at least at the relevant temperature measuring site.

As was stated above, cooler fluid from a primary circuit 19 can be metered into the respective secondary circuit 14; 16. In the simplest case (indicated by dashed lines in FIG. 4), this primary circuit 19 can be a circuit assigned only to the secondary circuits 14; 16 of a printing tower, and can comprise a pump 27; 28 and a cooling unit 33', and a discharge point and a return point for each secondary circuit 14; 16 to be supplied. However, it can also—as in the present case—have a higher-level circuit 29, which feeds a plurality of parallel primary circuit branches 35, for example, one for each printing unit 01 or printing tower 01 to be temperature controlled.

The primary circuit 19 (or in the case of multiple connected printing units 01, a branch of the primary circuit 19) has at least one pump 27; 28 and a cooling unit 33 for providing a cooling fluid that has been cooled to below the ambient temperature (e.g., a cooling machine, optionally with a storage tank), along with an infeed line 31; 34 and a return line 32; 26. In the present case, the infeed line 31, 34 is comprised of a line section of the infeed line 31 of the higher-level circuit 29 up to a discharge point 37 and a line section of the infeed line 34 of the relevant primary circuit branch 35. Accordingly, the return line 32, 36 is comprised of a line section of the return line 32 of the higher-level circuit 29 up to a return point 38 and a line section of the return line 36 of the relevant primary circuit branch 35. The infeed and return lines 34; 36 preferably extend in the printing unit 01 essentially vertically as ascending and descending lines.

Preferably, in the embodiment comprising a higher-level circuit 29, both this higher-level circuit 29 and the primary circuit branches 35 have a pump 27; 28. It can thereby be ensured that each of the primary circuit branches 35 can be operated at the appropriate pressure, despite potentially different effective line resistances.

In addition to this separate pump 27, the primary circuit branch 35 also has a pressure compensating vessel 42, for example. The primary circuit branch 35 can have a valve 39, for example, a throttle valve, between a last discharge point 44 and a first return point 46, for the purpose of generating a pressure gradient between infeed line 34 and return line 36, and/or, in the case of no or only a low discharge of fluid into the connected secondary circuits 14; 16, for the purpose of ensuring a minimum circulation of fluid in the primary circuit branch 35. The action of the valve 39 is preferably adjustable, particularly embodied as remotely actuable. Particularly before or during a new start-up of the machine, the "warm" fluid standing in the lines of the primary circuit branch 35 can then be quickly temperature controlled or exchanged, and therefore, it does not need to flow first through the components that are to be temperature controlled.

The pump 27 is preferably operated such that it is regulated with respect to a differential pressure between infeed and return, particularly between a measuring site in the infeed line 34 downstream of the pump 27 and upstream of the first discharge point 44 and a measuring site in the return line 36 downstream of the last return point 46 in the primary circuit branch 35 and upstream of the return point 38 in the higher-level circuit 29, or is embodied so as to be operated in this manner together with the measuring sites. Preferably, the pump or a control module assigned to it is adjusted to a desired differential pressure, for example, to a differential pressure of between 1 and 3 bar, particularly a differential pressure of 1.8 to 2.3 bar. If the line resistances change, for example, as a result of changing discharge flows into the secondary circuits or as a result of a change in the adjustment of the valve 39, the appropriate differential pressure level is nevertheless maintained between infeed and return flow. This serves to ensure that the conditions for metering into the secondary circuits 14; 16 remain constant, thus allowing a more accurately calculable control process.

The higher-level circuit 29 can also have a valve 41, for example, a throttle valve, between the last discharge point 37 and the first return point 38, for the purpose of generating a pressure gradient between infeed line 31 and return line 32, and/or for ensuring a minimum circulation of fluid in the higher-level circuit 29 when there is no or only little discharge into the primary circuit branches 35.

In the present embodiment, a plurality of secondary circuits 14; 16 having the corresponding units, particularly at least one temperature sensor S01-S05, a pump 22, the metering valve 24, and optionally a heating appliance 26, for example, heating unit 26, are provided for the printing unit 01. Advantageously, a plurality of assemblies 43 containing units of the secondary circuits 14; 16 are assigned to the printing unit 01, close to the printing couple, particularly one above the other (see FIGS. 1 to 3). Each of these assemblies 43 contains the metering valve 24. The assemblies 43 are preferably located approximately at the height of the printing couples 04, which contain the components 07; 12 that are to be temperature controlled with the assembly 43. The assemblies 43 are preferably disposed at the end face of the printing unit 01 (i.e., on an end face machine side of the cylinders 06; 07), for example, on the side frame 02; 03 or on a frame part that is connected to the latter, particularly within a chamber 10 disposed at the end face and having supply lines and optionally auxiliary units, for example, also called an end face control cabinet 10 (e.g., containing supply and/or control systems and mechanisms). The chamber is formed, for example, by the side frame 02 on one side, and by enclosures which, together with the side frame 02, enclose a chamber 10 inside optional side panels and a closeable front panel. This integrated disposition of the assemblies 43 in or on the side frame 02 allows every secondary circuit 14; 16 to be positioned close to the printing couple, particularly the infeed point 21 close to the printing couple, resulting in a substantially reduced reaction time. The chamber 10 can be embodied as essentially continuous over the end face or, for example, in the case of printing units 01 that are separable at the center (as shown here), as two chambers 10 that can be separated at least partially at the center. In the case of separable printing units 01, however, it is also possible for only one chamber 10 to be provided, the halves of which are then also open toward the center, for example, when the printing unit 01 is in the opened position.

The secondary circuits 14; 16 are preferably located at the end face that is opposite the drive side SII.

For each anilox roller 12 of the printing unit 01, a secondary circuit 16 having the corresponding units (at least one temperature sensor S01-S05, a pump 22, and in the case of an anilox roller 12, preferably also a heating unit 26 in the secondary circuit 16) is preferably provided. In one advantageous embodiment, these secondary circuits 16 are then housed close to the printing couple in the individual components 43, according to the illustration of FIG. 1 and the schematic illustration of FIG. 2.

In principle, forme cylinders 07 to be temperature controlled in different printing couples 04 can be fed from a shared secondary circuit 14. However, it is advantageous for each forme cylinder 07 to be temperature controlled by its own secondary circuit 14.

If each of the forme cylinders 07 and the anilox rollers 12 of all the printing couples 04 of the printing unit 01 has its own temperature control, then a number of secondary circuits 14 (in this case eight) assigned to the forme cylinders 07, which corresponds to the number of printing couples 04, and a number of secondary circuits 16 (in this case eight) assigned to the anilox rollers 12, which corresponds to the number of printing couples 04, are provided. In this case, the units of the secondary circuits 14; 16 relating to the same printing couple 04 can preferably be configured in the manner of an assembly 43. A number of these that corresponds to the number of printing couples 04 can then be arranged in essentially the same configuration in the printing unit 01, or on the end face thereof, particularly one above the other at different heights from each other. In principle, units of secondary circuits 14; 16 relating to multiple, particularly adjacent printing couples 04 can also be configured in the manner of an assembly 43. For instance, the units of two secondary circuits 16 for anilox rollers 12 and the units of one secondary circuit 14 for two forme cylinders 07 or the units of two secondary circuits 14 for two forme cylinders 07 could be arranged in the manner of an assembly 43 in multiples, for example, a total of four (two per side, one above the other) in the printing unit 01 or in the side enclosure.

An advantageous embodiment, particularly for the case of a separably embodied printing unit 01, is one in which a left primary circuit branch 35 is provided for the left printing couples 04 and a right primary circuit branch 35 is provided for the right printing couples 04, each branch having the corresponding infeed and/or return lines 34; 36. On the line route between the ascending and descending lines of the movable part of a separable printing unit 01 and the respective discharge or return point 37; 38 from the higher-level circuit 29, flexible line sections, for example, hose pieces, are then preferably provided.

As was already mentioned above, it is advantageous for units of the primary circuit 19—e.g., the pump(s) 27 and optionally provided pressure compensating vessels 42—assigned to a specific printing unit 01 to be disposed in a plane below the base plane G, i.e., below the main operating plane G, and/or in a plane below the base of the printing unit 01, for example, in the depression 09 that can be covered, for example. In the case of a printing unit in a table configuration, in other words set up at the level of a walkway, the depression 09 is also embodied, for example, as positioned below the level of the base frame where press operators stand or walk, or as a recess located in the walkway frame. If the depression 09 or trench 09—as is advantageous—is embodied as optionally coverable, it is accessible, but does not interfere spatially with the operation of the machine from the end face thereof. The measure of recessing the units also serves to shorten the line routes, while at the same time ensuring accessibility to the instrument chamber.

In an embodiment comprising a plurality of printing units 01, all the printing units 01 therefore have the end-face, particularly coverable depression 09. This depression 09 contains the pumps 27 that pump the fluid in the respective primary circuit branch 35, and advantageously the connection points (discharge and return points 37; 38) between the higher-level primary circuit 29 and the corresponding primary circuit branches 35 (of the relevant printing unit 01), which can be accessed easily as needed.

The "architecture" of the temperature control device is therefore embodied as effective, space-saving and allowing an extremely rapid reaction, in that a higher-level circuit 29 (extending substantially horizontally between the printing towers 01) conducts a fluid that is cooled to below the ambient temperature, and fluid is discharged from the higher-level circuit 29 at each of the respective printing towers 01 and circulates in a primary circuit branch 35 (extending essentially vertically through the or at the printing towers 01), wherein discharge points 44 from the primary circuit branch 35 for the secondary circuits 14; 16 to be temperature controlled and for the essential units thereof (e.g., pump 22 and metering valve 24) are located as close as possible to the component, i.e., distributed at different heights in the printing tower 01.

While a preferred embodiment of printed presses having one or more printing units embodied as printing towers for double-sided, multicolor printing, and devices for controlling the temperature of components of one or more of the printing units, in accordance with the present invention, has been described fully and completely hereinabove, it will be apparent to one of skill in the art that changes in, for example, the particular construction of the printing couple components, the drives for the printing couple components, the frames for the printing units, and the like could be made without departing from the true spirit and scope of the present invention which is accordingly to be limited only by the appended claims.

What is claimed is:

1. A printing press comprising one or more printing units (01) embodied as printing towers for double-sided multicolor printing, and a device for controlling the temperature of components of one or more of the printing units (01), wherein the printing unit (01) comprises a plurality of printing couples (04) arranged vertically, one above the other, each having at least one component (07; 12) to be temperature controlled, wherein the component (07; 12) to be temperature controlled is in thermal interaction via an intake (17) with fluid of a secondary circuit (14; 16) for the purpose of controlling the temperature of said component, wherein fluid from a primary circuit (19; 29, 35) can be metered via an infeed point (21) to the secondary circuit (14; 16), for the purpose of controlling the temperature thereof, wherein at least two components (07; 12) to be temperature controlled, assigned to different printing couples (04), are in thermal interaction with two different secondary circuits (14; 16) for the purpose of controlling the temperature of said components, characterized in that, in addition to the infeed point (21), a selectively actuable electric heating appliance (26) is provided in the secondary circuit (14; 16), and in that at least the valves (24) and/or pumps (22) and/or heating appliances (26) assigned to the two different secondary circuits (14; 16) are disposed on an end face side of the machine at different heights from each other and/or can be supplied with fluid from the primary circuit (19; 29, 35) via infeed points (21) disposed at different heights from each other.

2. The printing press according to claim 1, characterized in that at the end face of the printing unit (01), a depression (09) is provided in a base plane (G) that supports the printing unit (01), in which depression at least one pump (27) for pumping the fluid of the primary circuit (19) is disposed, recessed in relation to the surrounding area.

3. The printing press according to claim 2, characterized in that at least one primary circuit branch (35), having a pump (27) disposed in an end-face depression (09), is assigned to each printing unit (01), said branches being connected to a common, higher-level primary circuit (29) that feeds into the primary circuit branches (35) of the printing unit (01).

4. The printing press according to claim 3, characterized in that a valve (41) is disposed between a last discharge point (37) and a first return point (38) of the higher-level circuit (29).

5. The printing press according to claim 2, characterized in that the recessed pump (27) is located in a primary circuit branch (35), which is connected to a discharge point (37) and a return point (38) of a higher-level circuit (29).

6. The printing press according to claim 2, characterized in that an intake to the component (07; 12) and the depression (09) are provided on the end face that is opposite a drive side (S II) of the component (07; 12).

7. The printing press according to claim 1, characterized in that the heating appliance (26), the valve (24), the pump (22) and, if applicable, the infeed point (21) are components of an assembly (43), particularly of an assembly (43) that can be installed pre-assembled.

8. The printing press according to claim 1, characterized in that for each of the printing couples (04) of the printing unit (01), at least one secondary circuit (14; 16) is provided and/or one assembly (43) comprising at least the infeed point (21), the valve (24) and the pump (22) of a secondary circuit is assigned, particularly on the machine side that is opposite the drive side (S II).

9. The printing press according to claim 1, characterized in that at the end face of the printing unit (01), a depression (09) is provided in a base plane (G) that supports the printing unit (01), in which depression at least one pump (27) of the primary circuit (19), particularly a pump (27) of a primary circuit branch (35) assigned to the printing unit (01), is disposed.

10. The printing press according to claim 1, characterized in that the printing unit (01) is embodied as a printing unit (01) that can be separated in the region of its print positions (05), and comprises panel sections, the distance between which can be adjusted.

11. The printing press according to claim 10, characterized in that an infeed line and a return line (34; 36) of the primary circuit (19, 35) are assigned to each of the two parts of the separable printing unit (01).

12. The printing press according to claim 1, characterized in that a plurality of printing units (01) are provided, spaced horizontally from one another, the secondary circuits (14; 16) of which are connected to a common primary circuit (19; 29, 35) for the purpose of supply.

13. The printing press according to claim 12, characterized in that at least one primary circuit branch (35) is assigned to each printing unit (01), said branches being connected to a common, higher-level primary circuit (29).

14. The printing press according to claim 1, characterized in that printing couple cylinders (06; 07) of the printing couple (04), embodied as forme cylinder (07) and transfer cylinder (06), are rotationally driven on the drive side (SII) by at least one drive motor (11) which is mechanically independent of the other printing couples (04).

15. The printing press according to claim 1, characterized in that the printing couples (04) of the printing unit (01) are embodied as dry offset printing couples.

16. The printing press according to claim 1, characterized in that memory and/or computing means are provided in a regulating and/or control device (25) or a machine control center or a control panel, by means of which a target temperature value for the component (07; 12) to be temperature controlled or for the circulating fluid can be determined on the basis of a machine speed and/or on the basis of data on the type of ink being used.

17. The printing press comprising one or more printing units (01) embodied as printing towers for double-sided multicolor printing, and a device for controlling the temperature of components (07; 12) of one or more printing units (01), wherein the printing unit (01) has a plurality of printing couples (04) arranged vertically, one above the other, each having at least one component (07; 12) to be temperature controlled and having printing couple cylinders (06; 07), driven on a drive side (SII) by at least one drive motor (11), wherein at least two components (07; 12) to be temperature controlled, which are assigned to different printing couples (04), are in thermal interaction with two different secondary circuits (14; 16) for the purpose of controlling the temperature of said components, wherein each of the secondary circuits (14; 16) has at least one pump (22) and one infeed point (21), and wherein fluid from a primary circuit (19; 29, 35) can be metered, via a valve (24) at the infeed point (21) of the secondary circuit (14; 16), into the respective secondary circuit (14; 16) for the purpose of controlling the temperature thereof, characterized in that at least the valves (24) and/or pumps (22) and/or infeed points (21) assigned to the two different secondary circuits (14; 16) are disposed at different heights from each other, at an end face of the machine, in that the two secondary circuits (14; 16) are connected via the valves (24) to the same, essentially vertically extending infeed line (34) of the primary circuit (19), and in that the secondary circuits (14; 16), which are disposed at different heights from each other, are arranged on the end face of the printing unit (01) that is opposite the drive side (S II).

18. The printing press according to claim 17, characterized in that the valves (24), pumps (22) and infeed points (21) assigned to the vertically offset secondary circuits (14; 16) are disposed in an end-face chamber (10), which is formed by the side frame (02) and by enclosures that can be closed in the manner of a housing, particularly a control cabinet (10).

19. The printing press according to claim 17, characterized in that the valves (24), pumps (22) and infeed points (21)

assigned to the vertically offset secondary circuits (14; 16) are arranged vertically offset from one another in such a way that the distance between the valve (24) and the intake into a component (07; 12) to be temperature controlled is substantially the same for two components of the same type that are to be temperature controlled by the two secondary circuits (14; 16).

20. The printing press according to claim 17, characterized in that the at least two secondary circuits (14; 16) are connected via the valves (24) to the same substantially vertically extending infeed line (34) of the primary circuit (19).

21. The printing press according to claim 20, characterized in that the at least two secondary circuits (14; 16) are connected via the valves (24) to the same, substantially vertically extending infeed line (34) of a primary circuit branch (35) of the primary circuit (19).

22. The printing press according to claim 17, characterized in that for each of the printing couples (04) of the printing unit (01), a secondary circuit (14) is provided for controlling the temperature of a component (07) embodied as a forme cylinder (07), and a secondary circuit (16) is provided for controlling the temperature of a component (12) embodied as an anilox roller (12).

23. The printing press according to claim 22, characterized in that the valves (24), the pumps (22) and the infeed points (21) of the two secondary circuits (14; 16) assigned to the same printing couple (04) are components of an assembly (43) that can be installed pre-assembled.

24. The printing press according to claim 17, characterized in that on or adjacent to a side frame (02) of the printing unit (01), at least one infeed line and one return line (34; 36) of the primary circuit (19, 35) extends particularly substantially vertically, up to the height of a branch for the secondary circuit (14; 16) of the uppermost printing couple (04).

25. The printing press according to claim 17, characterized in that in the primary circuit (19) or primary circuit branch (35) that feeds into the at least two secondary circuits (14; 16), a valve (39) is provided between a last discharge point (44) and a first return point (46).

26. The printing press comprising a plurality of printing units (01) embodied as printing towers for double-sided multicolor printing, and a device for controlling the temperature of components (07; 12) of one or more printing units (01), wherein the printing unit (01) comprises a plurality of printing couples (04) arranged vertically, one above the other, each having at least one component (07; 12) to be temperature controlled and having printing couple cylinders (06; 07) driven on a drive side (SII) by at least one drive motor (11), wherein the component (07; 12) to be temperature controlled is in thermal interaction with a secondary circuit (14; 16) for the purpose of controlling the temperature of said component, wherein the secondary circuit (14; 16) has at least one pump (22) and one infeed point (21), and wherein fluid from a primary circuit (19; 29, 35) can be metered, via a valve (24) at an infeed point (21) of the secondary circuit (14; 16), into the secondary circuit (14; 16) for the purpose of controlling the temperature thereof, characterized in that at least one primary circuit branch (35) is assigned to each printing unit (01), with said branches being connected to a common, higher-level primary circuit (29) that supplies the primary circuit branches (35) of the printing units (01), and in that each of the primary circuit branches (35) has at least one pump (27) assigned to the primary circuit branch (35), which pumps the fluid of the primary circuit (19).

27. The printing press according to claim 26, characterized in that at least two components (07; 12) to be temperature controlled, which are assigned to different printing couples (04) of the printing unit (01), are in thermal interaction with two different secondary circuits (14; 16) for controlling the temperature of said components, wherein each of the secondary circuits (14; 16) has at least one pump (22) and one infeed point (21), wherein at least the valves (24) and/or pumps (22) and/or infeed points (21) that are assigned to the two different secondary circuits (14; 16) are disposed on an end face of the machine, at different heights from each other.

28. The printing press according to claim 26, characterized in that in addition to the infeed point (21), a selectively actuable electric heating appliance (26) is provided in the secondary circuit (14; 16).

29. The printing press according to claim 26, characterized in that the valve (24) and the pump (22), and, if applicable, the infeed point (21) are components of an assembly (43), particularly an assembly (43) that can be installed pre-assembled.

30. The printing press according to claim 29, characterized in that the vertically offset secondary circuits (14; 16) are disposed substantially at the height of the printing couples (04), which contain the components (07; 12) that are to be temperature controlled by said secondary circuit (14; 16).

31. The printing press according to claim 29, characterized in that the vertically offset assemblies (43) are disposed at substantially the height of the printing couples (04) that contain the components (07; 12) to be temperature controlled by this respective assembly (43).

32. The printing press according to claim 26, characterized in that on or adjacent to a side frame (02) of the printing unit (01), at least one infeed line and one return line (34; 36) of a primary circuit branch (35) of the primary circuit (19) extends particularly substantially vertically, up to the height of a branch for the secondary circuit (14; 16) of the uppermost printing couple (04).

33. The printing press according to claim 26, characterized in that the pump (27) that pumps the fluid of the primary circuit (19; 35) or primary circuit branch (35) is embodied as operable under a predefinable differential pressure between infeed and return.

* * * * *